United States Patent [19]

Walbridge

[11] Patent Number: 4,946,003

[45] Date of Patent: Aug. 7, 1990

[54] MOBILE AND AERIAL LIFT HAVING OFFSET BOOM SUPPORT

[75] Inventor: Van J. Walbridge, Arvada, Colo.

[73] Assignee: GK Technologies, Inc., Woodcliff Lake, N.J.

[21] Appl. No.: 280,889

[22] Filed: Dec. 7, 1988

[51] Int. Cl.[5] ..... B66F 11/04

[52] U.S. Cl. ..... 182/2

[58] Field of Search ..... 182/2, 63, 141

[56] References Cited

U.S. PATENT DOCUMENTS

| | | | |
|---|---|---|---|
| 3,005,512 | 10/1961 | Vogan | 182/2 |
| 3,258,084 | 6/1966 | Robb | 182/2 |
| 3,437,175 | 4/1969 | Eitel | 182/2 |
| 3,596,976 | 8/1971 | Eitel | 182/2 |

*Primary Examiner*—Reinaldo P. Machado
*Attorney, Agent, or Firm*—Flehr, Hohbach, Test, Albritton & Herbert

[57] ABSTRACT

A mobile aerial lift having a vehicle of the type having a frame with a longitudinal axis and ground-engaging wheels carried by the frame. An operator's driving station is carried by the frame. An aerial lift is carried by the frame and includes a boom structure and control means for the boom structure which permits the outer extremity of the boom structure to be raised and lowered about a horizontal axis, rotated about a vertical axis, and extended and retracted. A mast is provided for carrying the boom structure and is secured to one side of the frame and is spaced from the longitudinal axis of the frame.

6 Claims, 5 Drawing Sheets

MOBILE AND AERIAL LIFT HAVING OFFSET BOOM SUPPORT

This invention relates to a mobile aerial lift and more particularly to a mobile aerial lift having a boom support which is offset from the longitudinal axis of the vehicle.

Various types of lifting equipment and aerial lifts have heretofore been provided. In U.S. Pat. No. 2,935,984 there is disclosed a vehicle and lift construction in which the workman's basket can be placed at a level adjacent the driving station to permit the vehicle operator to enter the workman's basket without dismounting from the vehicle. In U.S. Pat. No. 3,437,175 there is disclosed a lifting equipment in which particular drive means is disclosed for rotating the lifting equipment. In such lifting equipment, it has been found to be desirable to mount the boom support along the longitudinal axis of the vehicle equidistant between the rear wheels of the vehicle. It has been found that the mounting of the boom support for the aerial lift in such a location encumbers the bed area of the vehicle making it difficult to pass between the front and rear of the bed of the vehicle and also making it difficult to utilize the bed of the truck or interior of any enclosure provided over the bed of the vehicle. There is therefore a need for a new and improved vehicle and aerial lift.

In general, it is an object of the present invention to provide a mobile aerial lift in which the boom support is offset from the longitudinal axis of the vehicle by mounting on one side of the frame of the vehicle.

Another object of the invention is to provide a mobile aerial lift of the above character in which the vehicle is provided with a bed in which the bed area remains relatively open for the storage of materials.

Another object of the invention is to provide a mobile aerial lift of the above character which has an additional side reaching capabilities.

Another object of the invention is to provide a mobile aerial lift of the above character in which the vehicle is provided with stability by the use of a torsion bar.

Additional objects and features of the invention will appear from the following description in which the preferred embodiments are set forth in detail in conjunction with the accompanying drawings.

Figure 1:
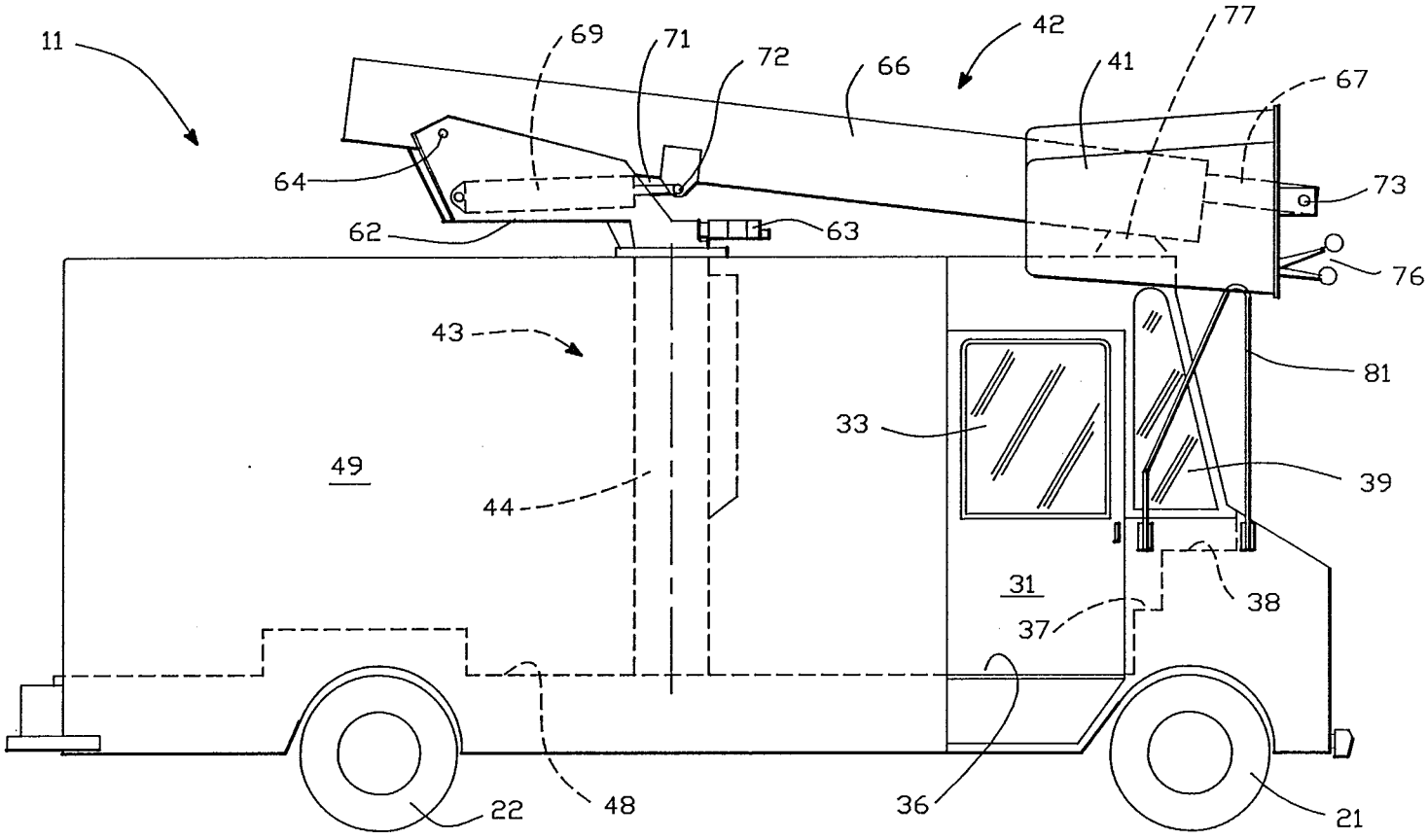
FIG. 1 is a side elevational view of mobile aerial lifts incorporating the present invention.
Figure 2:
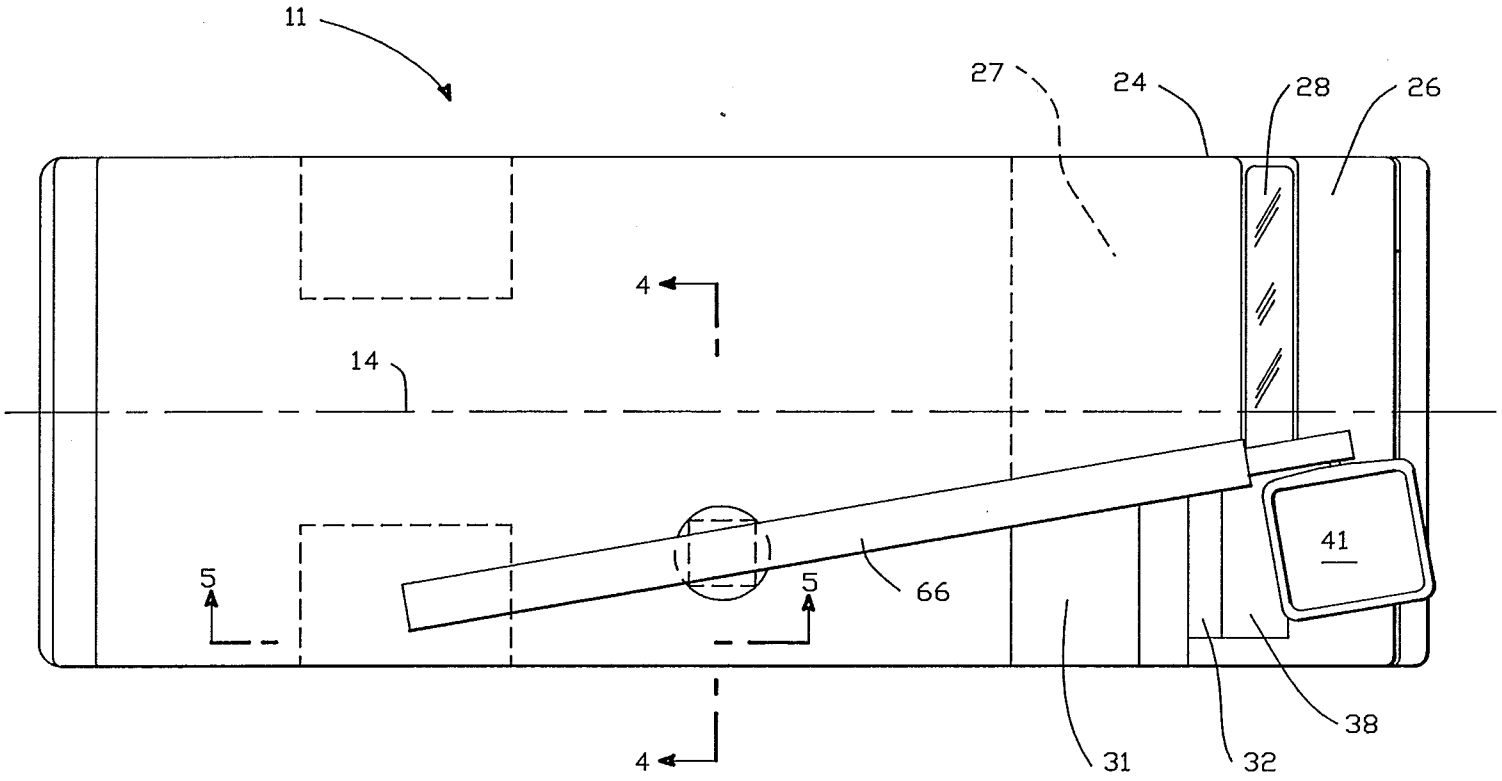
FIG. 2 is a top plan view of the mobile aerial lift shown in FIG. 1.
Figure 3:
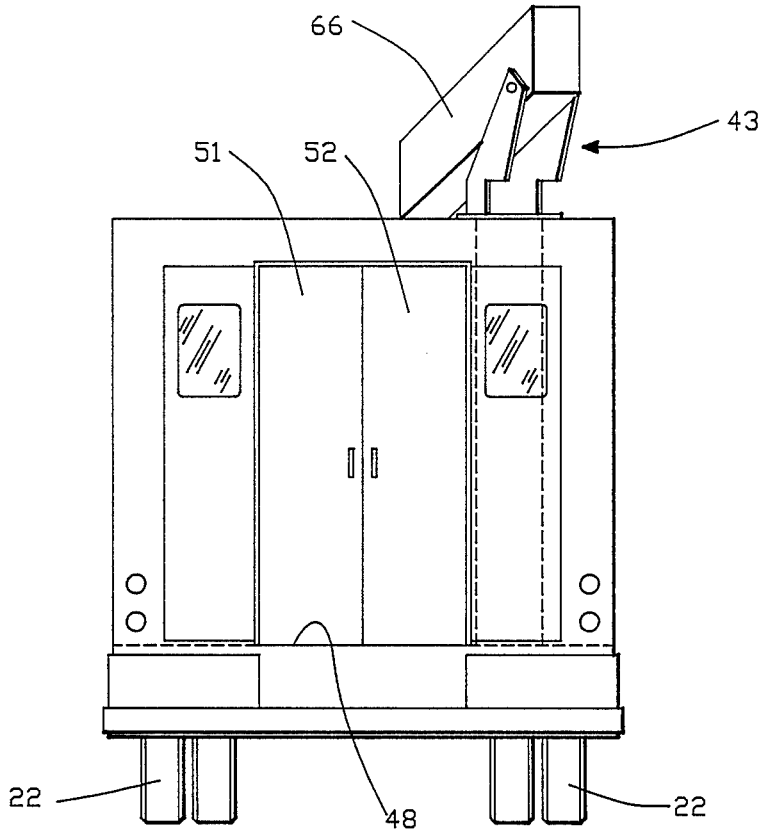
FIG. 3 is a rear elevational view of the mobile aerial lift shown in FIG. 1.
Figure 4:
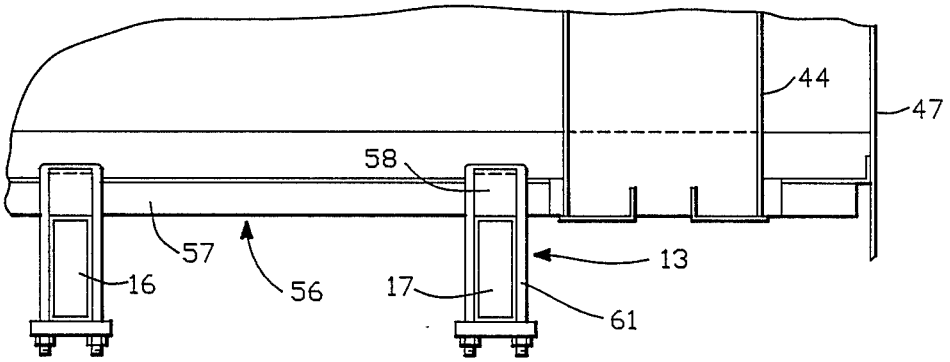
FIG. 4 is a cross sectional view taken along the line 4—4 of FIG. 2.

In general, the mobile aerial lift of the present invention is comprised of a vehicle of the type having a frame with a longitudinal axis and ground engaging wheels carried by the frame and an operator's driving station carried by the frame. An aerial lift is carried by the frame of the vehicle. The aerial lift includes a boom structure, the outer end of which can be raised and lowered about a horizontal axis, rotated about a vertical axis and extended and retracted. The lift also includes a boom structure or pedestal for carrying the boom structure. Means is provided for mounting and securing the boom support to the frame of the vehicle on one side of the frame and spaced transversely from the longitudinal axis of the frame. A bed is mounted on the frame to the rear of the operator's driving station and provides an upwardly facing space which is substantially encumbered by the pedestal for the boom structure.

More in particular, the mobile aerial lift 11 of the present invention is shown in FIGS. 1–5 and consists of a vehicle 12 which is provided with a frame 13 that extends longitudinally of the vehicle and has a longitudinal axis 14 that is centered with respect to the sides of the vehicle 12. The frame 13 includes first and second rails or frame members 16 and 17 which extend longitudinally of the vehicle parallel to the longitudinal axis 14. Front and rear ground engaging wheels 21 and 22 respectively are carried by the frame 13.

A cab 24 is mounted on the front end of the frame and is provided with an engine compartment 26 which covers motorized drive means (not shown) for driving the rear wheels 22 of the vehicle. A driving station 27 is provided within the cab. A windshield 28 is provided in the cab 24 to give the driver at the driving station visibility from within the cab. Entrance doors 31 are provided on both sides of the cab to permit ingress and egress from the cab 24. Thus as shown in FIG. 1, there is provided a side opening door 31 which provides access from within the cab to a space 32 exterior of the cab on the front of the vehicle which opens upwardly and outwardly. The door 31 is provided with a window 33. An additional side window 34 is also provided for the cab 24 so that the driver has full view of the space 32. The door 31 in providing access to the space 32 also provides access to a platform 36 onto which the driver can step.

Steps 37 and 38 are provided forward of the platform 38 and make it possible for the driver of the vehicle to step from the platform 36 onto the steps 37 and 38 and thereby enter a workman's basket 41 which is carried by the outer extremity of a telescoping boom structure 42. The boom structure 42 forms a part of an aerial lift 43 mounted on the frame 13 of the vehicle 12. The aerial lift 43 includes a boom support, a pedestal or mast 44 which is carried by the frame 13 and extends through the roof 46 of a van-type body 47 mounted on the frame 13 to the rear of the cab 24. The interior of the van-like body 47 is provided with a bed 48 mounted on the rails 16 and 17 of the frame 13. A pair of rear doors 51 and 52 are provided on the rear of the van-like body to provide access to the bed space 49.

The aerial lift 43 which is utilized in the movable lifting equipment 11 is generally of a conventional construction such as that disclosed in U.S. Pat. No. 3,437,175.

In accordance with the present invention, the boom support 44 provided for the aerial lift 43 is mounted in a particular location on the frame 13 of the vehicle so that it is in an out-of-the way position with respect to the bed 48 and the space 49 within the van so that the bed 48 and the space 49 are readily accessible and substantially unencumbered by the boom support. To this end, the boom support 44 is mounted on one side of the vehicle and preferably outside of the longitudinal rails or members 16 on either side of the vehicle. In other words, the pedestal or mast 44 is secured to the frame 13 of the vehicle to one side of the frame 13 and spaced from and offset from the longitudinal axis 14 of the frame 13. In addition, it is preferable that the pedestal, mast or support structure 44 be spaced ahead of or to the rear of the drive axle (not shown) for the rear wheels 22 which generally extends along a line which is centered with respect to the wheels 22.

The pedestal, mast or boom support 44 is secured to a base 56. The base 56 is provided with spaced apart parallel transversely extending members 57 and spaced apart parallel longitudinally extending members 58 which extend at right angles to the members 57 and are fastened together by suitable means such as welding. The base 56 is secured to the frame members 16 and 17 by suitable means such as U-bolts 61 (see FIG. 4). As can be seen from FIG. 4, the pedestal or mast 44 is mounted upon the base and is secured to the base 56 in such a manner that it is mounted outboard of the frame members 16 and 17 but within the confines of the van-type body 47. The mast or pedestal 44 extends upwardly through the van and emerges from the roof 46 of the van.

The aerial lift 43 is provided with a pair of support arms 62 which are rotatably mounted upon the pedestal or mast 44 for movement about a vertical axis as defined by the mast 44. The rotational movement is provided by a drive motor 63. The boom structure 42 is pivotally mounted between the support arms 62 for swinging movement about a horizontal axis defined by the pivot pin 64 carried by the support arms 62. The boom structure 42 is provided with an outer boom 66 and an inner boom 67 which is telescopically mounted within the outer boom. The inner boom can be formed of a suitable insulating material such as fiberglass.

Means is provided for raising and lowering the outer boom 66 for swinging movement about the pivot 64 and includes a hydraulic actuator 69 which is provided with a piston rod 71 that is pivotally connected to the outer boom 66 at 72. Means (not shown) is provided for causing telescoping movement of the inner boom 67 with respect to the outer boom 66. The workman's basket 41 is pivotally on the outer extremity of the inner boom 67 at 73. Means (not shown) is provided for permitting such pivotal movement and also for stabilizing the movement of the basket so that the basket will generally hang in a vertical position regardless of the position of the boom structure.

A control mechanism 76 is provided adjacent the pivotal mounting 73 and is accessible to the workman or operator in the basket so that the boom structure can be controlled so that the outer extremity of the boom structure can be rotated about the vertical axis of the mast or pedestal 44, swung or in other words raised or lowered with respect to the horizontal axis 64 and extended and retracted.

A boom rest 81 is mounted on the front of the cab vehicle 24 and is provided for supporting the outer extremity of the boom structure 42 when the boom structure is stored in its home position for highway travel. The workman's basket 41 is moved to a generally horizontal position by controls (not shown) accessible within the cab 24. The basket 41 can be readily lowered into a vertical position by the same interior controls when the vehicle has arrived at a work location. A hand rail 83 is provided on the cab 24 for use by the operator in ascending and descending the steps 37 and 38.

Figures 5, 7:
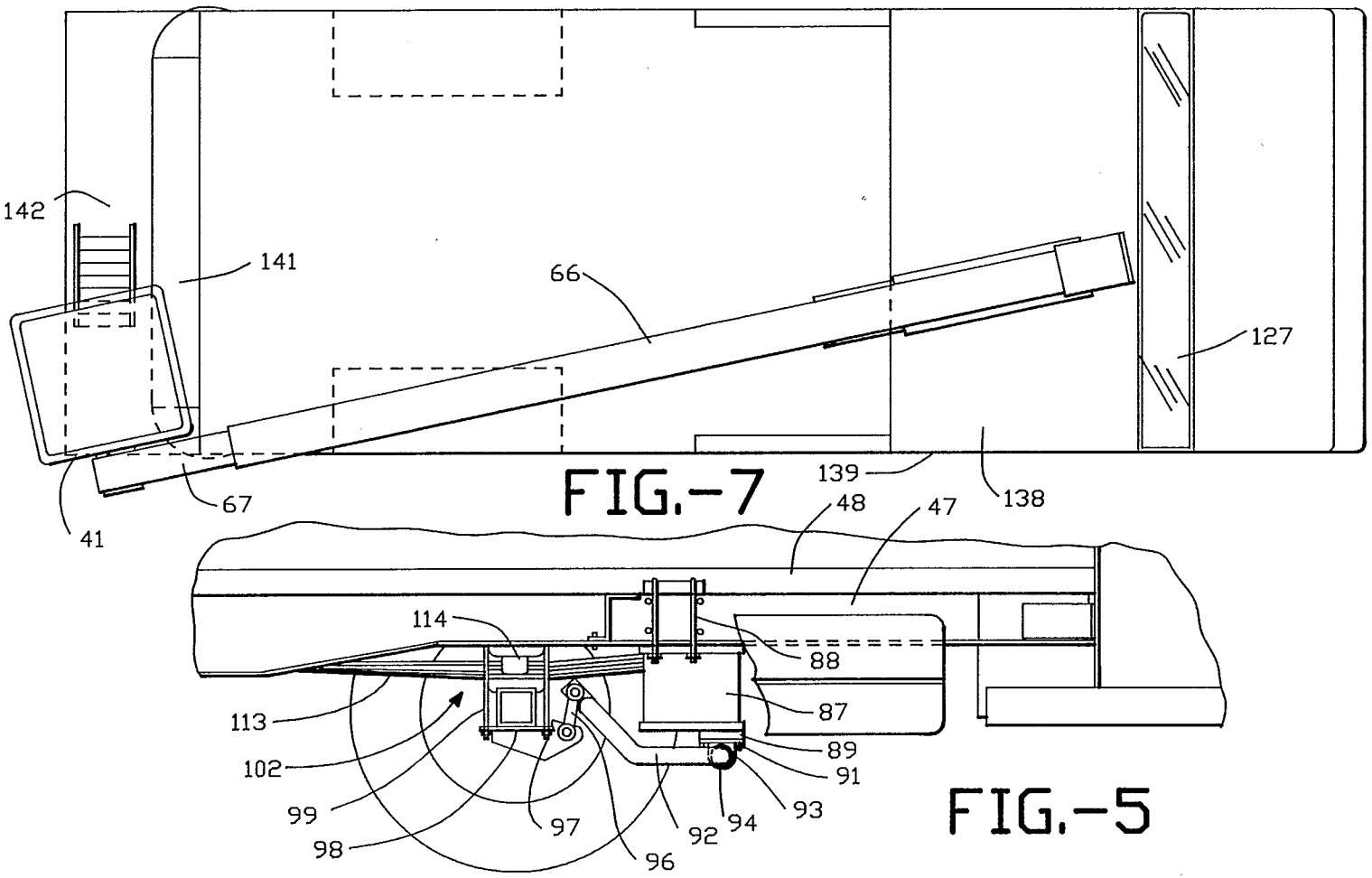
FIG. 5 is a cross sectional view taken along the line 5—5 of FIG. 2.

Additional means is provided on the vehicle 12 for stabilizing the vehicle during operation of the aerial lift 43 so that it can readily accommodate the side or offset mounting of the aerial lift as hereinbefore described. Such means consists of a torsion bar assembly 87 which is shown in FIG. 5.

The torsion bar assembly 86 consists of a weldment 87 which is secured to the frame members 16 and 17 by pairs of U-bolts 88. Another weldment 89 is provided which is secured to the weldment 87 by screws 91. A torsion bar or stabilizer rod 92 is carried by the weldment 89 by bushings 93 and torsion bar clamps 94 secured to the weldment 89. The torsion bar 92 is generally U-shaped as shown in the drawings and has its extremities pivotally connected to links 96. The links 96 are connected to shackle blocks 97 which are secured to plates 98. The plates 98 are secured by U-bolts 99 to a cross member 101 forming a part of the spring suspension system 102 provided for the vehicle. The spring suspension system includes leaf springs 113 and bumper blocks 114.

Operation and use of the mobile aerial lift 11 as shown in FIGS. 1-5 may now be briefly described as follows. In general, the mobile aerial lift 11 is operated in a conventional manner. The operator drives the vehicle 12 to the desired location as, for example, to change a lamp at a streetlight. The operator using controls accessible to him within the cab would cause the basket leveling device to permit the basket to swing downwardly so that it is in a vertical position. The operator can then pass through the door 31 and step onto the platform 36 and go up the steps 37 and 38 utilizing the handrail 82 to support himself and enter the basket.

After the operator has entered the workman's basket 41, the operator can operate the controls 76 to raise the boom structure 42 off of the support 77 and to move the basket to the desired position by rotating the basket 41 about the vertical axis provided by the mast 44, by raising and lowering the basket about the pivot axis 64 for the boom structure 42 and extending and retracting the insulated inner boom 67. After the work has been performed by the operator, by operating the control mechanism 76, the operator can return the basket 41 to its home or at rest position on the vehicle with the boom structure resting upon the boom rest 81. The operator can then leave the basket and go down the steps 37 and 38 and enter the driver's station 27 through the door 31 to move the vehicle to the next location. Generally it is desirable to swing the basket 41 to a horizontal position so that the view of the driver through the windshield is unobstructed by the basket 41.

Figure 6:
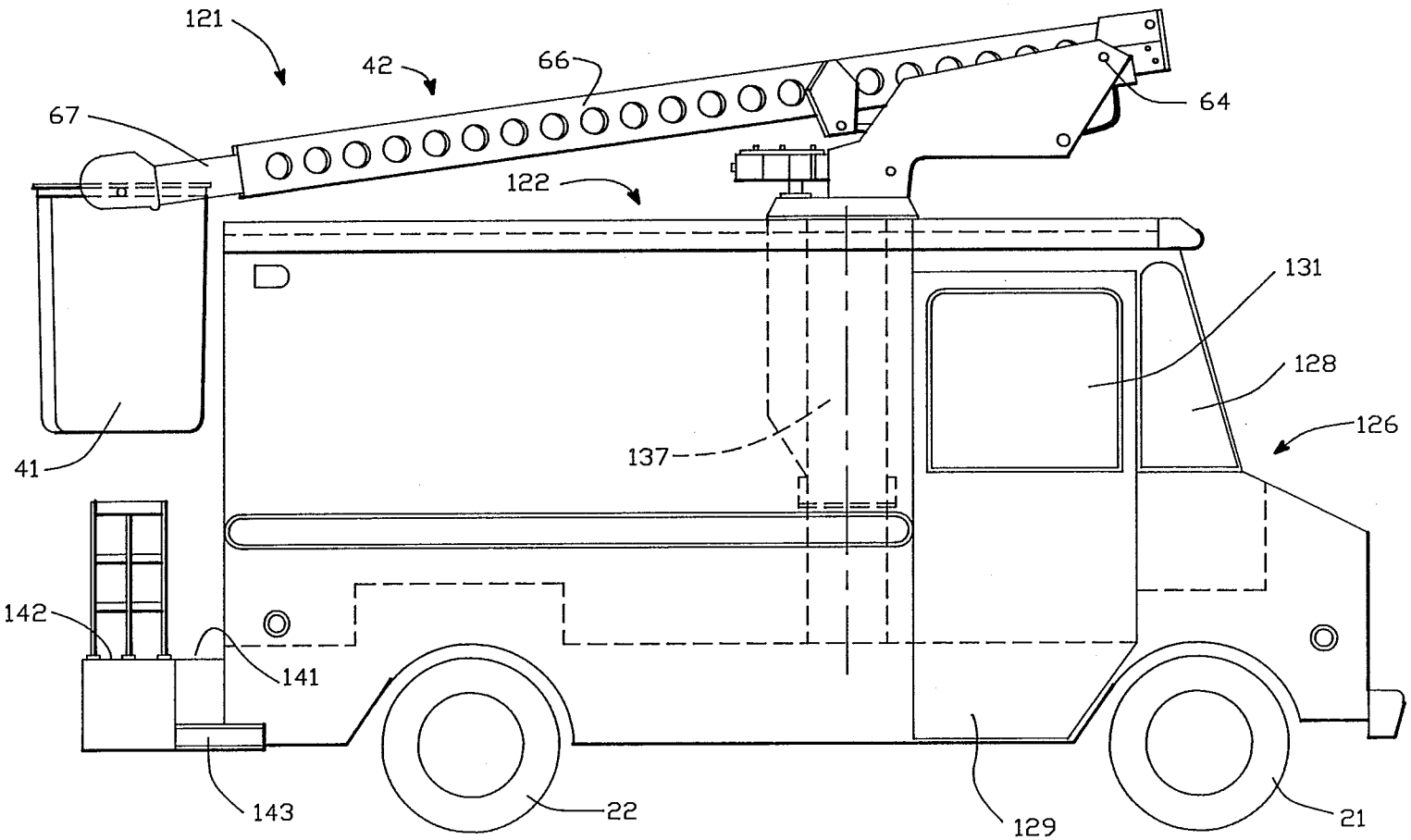
FIG. 6 is a side-elevational view of another embodiment of a mobile aerial lift incorporating the present invention.

It can be seen that with the present construction all of the advantages in the operation of the aerial lift that are present in other mobile aerial lifts are present in the aerial lift of the present invention. However, the mounting of the aerial lift in such a manner so that its mast is outboard or outside of the frame rails so that the bed area of the vehicle can be used for storage of materials to be utilized at the job site. Also, this permits ready access from the back to the front of the interior of the van. In addition the side mounting provides additional side reach for the basket 41 on the side of the vehicle on which the aerial lift is mounted. With the use of the half cab shown in FIGS. 1-5, it is possible for the operator to step directly from the driving station into the basket. Even though the mounting for the aerial lift is mounted outside of the frame rails, the vehicle still has adequate stability because of the torsion bar suspension. However, the advantages of increased load bed space as well as increased side reach can be utilized on a conventional cab and chassis utilizing the same concepts. For example, as shown in FIG. 6, a mobile lifting equipment 121 is provided which consists of a vehicle 122 which is provided with a longitudinal frame (not shown) which is substantially identical to the frame 13 and which is supported by front and rear wheels 21 and 22. A full cab 126, rather than a half cab 24, shown in the previous embodiment is utilized in the present invention with a front windshield 127 and side windshields 128. Doors 129 are provided on opposite sides of the cab 126 and permit access to the driving station within the cab. The doors are provided with windows 131. The aerial lift 136 which is provided is substantially identical to the aerial lift 43 hereinbefore described. The aerial lift 136 is provided with a mast or pedestal 137 which, rather than being mounted immediately to the front or the rear of the rear axle, is mounted adjacent the rear of the cab 126. It is cantilever mounted in the same manner as the pedestal or mast 44 off center or offset from the longitudinal axis of the frame and outside of the frame rails or members in the same manner as the mast 44. The mast 137 extends through a roof 138 of a van-like body 139 mounted on the framework of the vehicle 122. The boom structure 42 at the at-rest or at-home position extends rearwardly from behind the cab 126 so that the workman's basket 41 overlies a rear platform 141 mounted on the framework of the vehicle. An extension platform 142 is provided which is at the same level 141 and which can be extended by approximately two feet by the use of slidable rails 143 mounted on the platform 141. A step ladder 146 is mounted on the extension platform 142 and is provided with steps 147 which can be utilized by the operator to enter the workman's basket 41.

The cab 126 is open to the rear, the operator can move directly from the driving station through the interior of the unimpeded space of the van to the platform 142 and mount the stepladder to enter the workman's basket 41 without dismounting from the vehicle. By utilizing the control mechanism 76, the aerial lift can be operated much in the same manner as hereinbefore described to accomplish the desired work. It also can be returned to its at-home or rest position with the operator thereafter dismounting from the basket onto the step-ladder and then passing through the unimpeded space within the van and enter into the driving station of the vehicle.

As in the previous embodiment, a torsion bar assembly (not shown) is provided for stabilizing the vehicle. The mobile lift equipment of FIG. 6 has the same advantages of the embodiment hereinbefore described, namely, the large amount of accessible storage space on the bed of the truck, as well as the greater side reaching capability.

It is apparent from the foregoing that there has been provided a mobile aerial lift in which the mast for the boom structure is cantilevered off or offset to the side of the main frame which permits the bed area of the vehicle within the van to be opened up for storage materials. Also, additional side reaching capabilities are provided for the side on which the mast of the aerial lift is mounted.

What is claimed is:

1. In a mobile aerial lift, a vehicle of the type having a frame with a longitudinal axis, front and rear ground-engaging wheels carried by the frame, an operator's driving station carried by the frame, a van-type body carried by the frame to the rear of the operator's driving station, an aerial lift carried by the frame, the aerial lift including a boom structure and control means for the boom structure which permits the outer extremity of the boom structure to be raised and lowered about a horizontal axis, rotated about a vertical axis and extended and retracted, a mast carrying the boom structure and extending vertically through and above the van-type body so that the boom structure is adapted to extend over the van-type body and means securing the mast to the frame to one side of the frame and spaced from the longitudinal axis of the frame and between the front and rear ground engaging wheels.

2. A lift as in claim 1 together with a bed mounted on the frame and providing an upwardly facing space within the van-type body which is substantially unencumbered by the mast for the boom structure.

3. A mobile aerial lift as in claim 1 wherein the rear wheels are driven by a rear axle and wherein the mast is positioned so that it is spaced forwardly of the rear axle.

4. A mobile aerial lift as in claim 2 wherein the mast is positioned adjacent the rear of the driving station.

5. A mobile aerial lift as in claim 1 together with torsion bar stabilization means connecting the frame to the rear wheels so as to stabilize the frame during operation of the aerial lift.

6. In a mobile aerial lift, a vehicle of the type having a frame with a longitudinal axis, ground-engaging wheels carried by the frame, an operator's driving station carried by the frame, a van-type body carried by the frame to the rear of the operator's driving station, an aerial lift carried by the frame, the aerial lift including a boom structure and control means for the boom structure which permits the outer extremity of the boom structure to be raised and lowered about a horizontal axis, rotated about a vertical axis and extended and retracted, a mast carrying the boom structure and extending vertically through the van-type body, means securing the mast to the frame to one side of the frame and spaced from the longitudinal axis of the frame and a rear platform provided on the frame to the rear of the van-like body, said aerial lift including a workman's basket secured to the outer extremity of the boom structure, said boom structure being capable of assuming an at-home position in which the boom structure extends over the van-like body with the workman's basket overlying the rear platform whereby a workman can enter the workman's basket from the rear platform.

* * * * *